US009886048B2

(12) United States Patent
Du et al.

(10) Patent No.: US 9,886,048 B2
(45) Date of Patent: Feb. 6, 2018

(54) HEADROOM CONTROL IN REGULATOR SYSTEMS

(71) Applicant: QUALCOMM Incorporated, San Diego, CA (US)

(72) Inventors: Mengmeng Du, San Diego, CA (US); Hua Guan, San Diego, CA (US); Ngai Yeung Ho, San Diego, CA (US); Chi Fan Yung, Singapore (SG)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/256,315

(22) Filed: Sep. 2, 2016

(65) Prior Publication Data

US 2017/0322575 A1 Nov. 9, 2017

Related U.S. Application Data

(60) Provisional application No. 62/331,850, filed on May 4, 2016, provisional application No. 62/374,275, filed on Aug. 12, 2016.

(51) Int. Cl.
*G05F 1/565* (2006.01)
*G05F 1/575* (2006.01)

(52) U.S. Cl.
CPC ..... *G05F 1/575* (2013.01); *G05F 1/565* (2013.01)

(58) Field of Classification Search
CPC ... G05F 1/46; G05F 1/462; G05F 1/56; G05F 1/565; G05F 1/575
See application file for complete search history.

(56) References Cited

U.S. PATENT DOCUMENTS 6,417,736 B1 7/2002 Lewyn
7,960,957 B2 * 6/2011 Clavette ..... H02M 3/157 323/272
8,040,118 B2 * 10/2011 Cho ..... G05F 1/565 323/273
8,723,492 B2 5/2014 Korzeniowski
8,989,306 B1 * 3/2015 Yeung ..... G05F 1/10 375/297
2006/0033481 A1 2/2006 Thiele et al.
2009/0153108 A1 6/2009 Hendin et al.
(Continued)

FOREIGN PATENT DOCUMENTS

EP 1847901 A1 10/2007

OTHER PUBLICATIONS

International Search Report and Written Opinion—PCT/US2017/030462—ISA/EPO—dated Sep. 19, 2017.

*Primary Examiner* — Matthew Nguyen
(74) *Attorney, Agent, or Firm* — Qualcomm Incorporated/Seyfarth Shaw LLP

(57) ABSTRACT

A voltage regulator control implementation dynamically detects and sets specified headroom for a low dropout (LDO) regulator at different loads to enable the LDO regulator to maintain high performance in conjunction with improved power efficiency. In one instance, an upstream voltage regulator may adaptively adjust an output voltage supplied to an input supply rail of a downstream LDO regulator based on an indication from the LDO regulator. The adaptively adjusted input voltage enables the downstream LDO regulator to achieve high performance and improved power efficiency across the entire range of load conditions.

20 Claims, 9 Drawing Sheets

(56) References Cited

U.S. PATENT DOCUMENTS

| | | | | |
|---|---|---|---|---|
| 2011/0169423 | A1 | 7/2011 | Huang et al. | |
| 2012/0013317 | A1* | 1/2012 | Morino | G05F 1/565 323/280 |
| 2012/0081016 | A1 | 4/2012 | Wu et al. | |
| 2013/0176007 | A1* | 7/2013 | Devegowda | G05F 1/573 323/273 |
| 2014/0228079 | A1 | 8/2014 | Patel et al. | |

* cited by examiner

HEADROOM CONTROL IN REGULATOR SYSTEMS

CROSS-REFERENCE TO RELATED APPLICATION

The present application claims the benefit of U.S. Provisional Patent Application No. 62/374,275, filed on Aug. 12, 2016, and titled "HEADROOM CONTROL IN REGULATOR SYSTEMS," and U.S. Provisional Patent Application No. 62/331,850, filed on May 4, 2016, and titled "HEADROOM CONTROL IN REGULATOR SYSTEMS," the disclosures of which are expressly incorporated by reference herein in their entireties.

TECHNICAL FIELD

The present disclosure generally relates to power management systems. More specifically, aspects of the present disclosure relate to headroom control in a voltage regulator system.

BACKGROUND

A wireless device (e.g., a cellular phone or a smartphone) in a wireless communication system may transmit and receive data for two-way communication. The wireless device may include a transmitter for data transmission and a receiver for data reception. For data transmission, the transmitter may modulate a radio frequency (RF) carrier signal with data to obtain a modulated RF signal, amplify the modulated RF signal to obtain an amplified RF signal having the proper output power level, and transmit the amplified RF signal via an antenna to a base station. For data reception, the receiver may obtain a received RF signal via the antenna and may amplify and process the received RF signal to recover data sent by the base station.

Many modern electronic systems (e.g., wireless device) rely on one or more batteries for power. The batteries are typically recharged, for example, by connecting the electronic system to a power source (e.g., an alternating current (AC) power outlet) via a power adapter and cable.

A regulator or voltage regulator may provide a power supply rail from a battery. The voltage regulator increasingly has to service multiple subsystems (e.g., loads) in electronic devices. These subsystems may have different power supply voltage specifications and load current specifications. The power delivery capability of the voltage regulator, however, is limited by the power available from the battery. Under certain conditions, the voltage regulator may not be able to provide sufficient power to meet all the demands of all the device subsystems. When load currents of multiple ones of the device subsystems increase, the power supply voltage at the output of the voltage regulator (Vout) may droop, causing one or more of the device subsystems to fail.

SUMMARY

In an aspect of the present disclosure, a method for headroom control in a voltage regulator is presented. The method includes computing a minimum headroom of the voltage regulator based on a dynamic load current and current operation conditions of the voltage regulator. The method also includes determining an offset value based on a difference between the minimum headroom and a current headroom of the voltage regulator according to a difference between an input voltage ($V_{IN}$) and an output voltage ($V_{OUT}$) of the voltage regulator. The method further includes adjusting a load power to be provided to a client device coupled to the voltage regulator based on the offset value.

In another aspect of the present disclosure, a power management integrated circuit is presented. The power management integrated circuit includes a downstream voltage regulator having a power transistor to supply a load power including an output voltage supply rail according to an input supply rail from an upstream voltage regulator. The power management integrated circuit also includes a tracking circuit to dynamically detect a target operating condition for the power transistor and a target headroom of the downstream voltage regulator corresponding to the target operating condition of the power transistor. The dynamic detection is based on a dynamic load current and current operation conditions of the downstream voltage regulator. The power management integrated circuit further includes feedback circuitry to generate an offset value based on a difference between the target headroom and a current headroom of the downstream voltage regulator. Furthermore, the power management integrated circuit includes load power adjustment circuitry to adjust the load power to a client device coupled to the downstream voltage regulator based on the offset value.

In yet another aspect of the present disclosure, a power management integrated circuit is presented. The power management integrated circuit includes means for supplying a load power including an output voltage supply rail according to an input supply rail from an upstream voltage regulator. The power management integrated circuit also includes means for dynamically detecting a target operating condition for the load power supplying means and a target headroom of the load power supplying means corresponding to the target operating condition of the load power supplying means. The dynamic detection is based on a dynamic load current and current operation conditions of the load power supplying means. The power management integrated circuit further includes feedback circuitry to generate an offset value based on a difference between the target headroom and a current headroom of the load power supplying means. Furthermore, the power management integrated circuit includes load power adjustment circuitry to adjust the load power to a client device coupled to the load power supplying means.

Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

Figure 1:
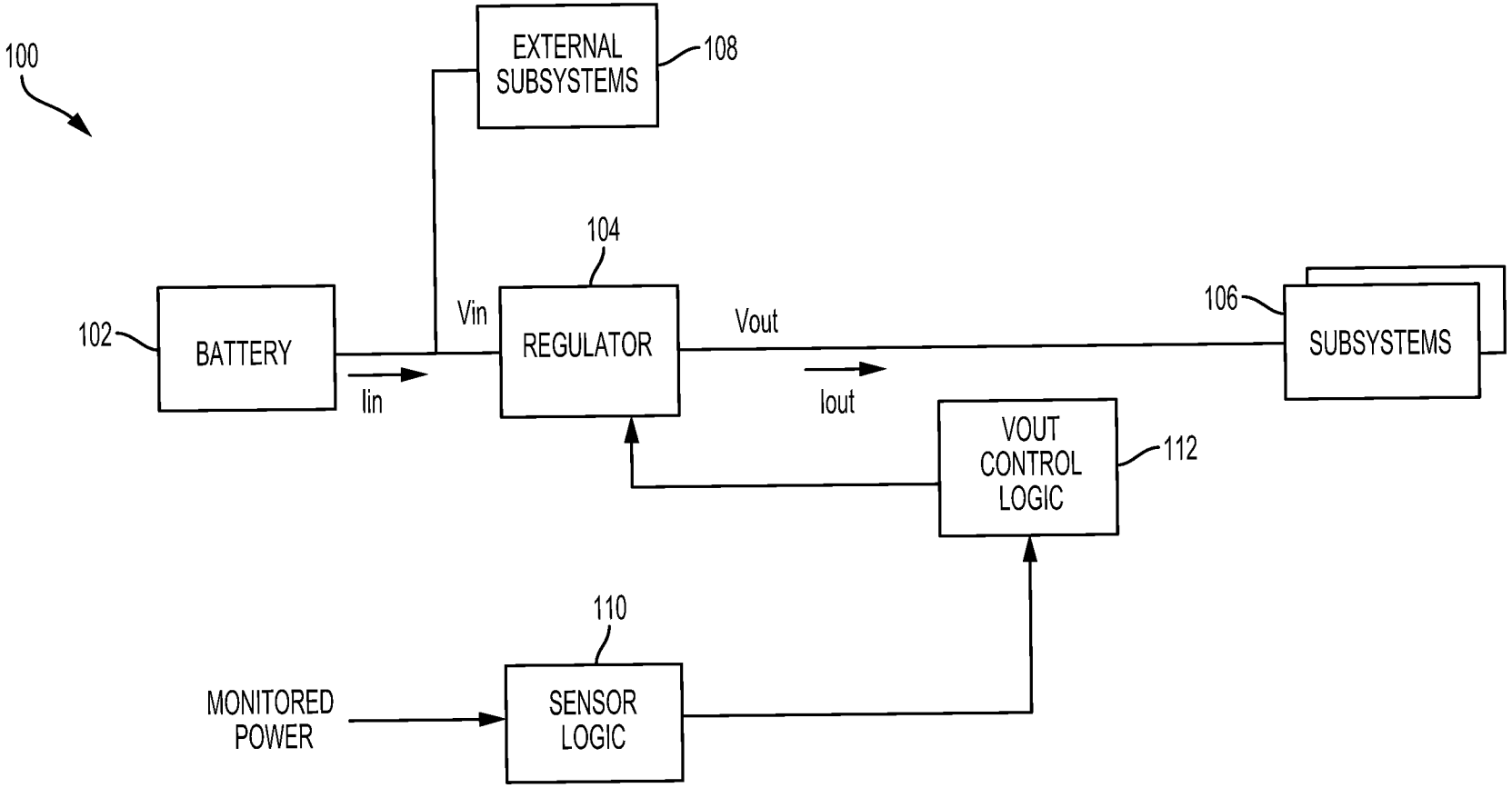
FIG. 1 depicts a simplified system for delivering power in an electronic device according to one aspect of the present disclosure.

The detailed description set forth below, in connection with the appended drawings, is intended as a description of various configurations and is not intended to represent the only configurations in which the concepts described herein A may be practiced. The detailed description includes specific details for the purpose of providing a thorough understanding of the various concepts. It will be apparent to those skilled in the art, however, that these concepts may be practiced without these specific details. In some instances, well-known structures and components are shown in block diagram form in order to avoid obscuring such concepts. As described herein, the use of the term "and/or" is intended to represent an "inclusive OR" and the use of the term "or" is intended to represent an "exclusive OR".

A linear voltage regulator generally produces a regulated direct current (DC) output voltage rail ($V_{OUT}$) from an input supply voltage rail ($V_{IN}$), in which unwanted, excess voltage is dropped across the linear voltage regulator. This excess voltage ($=V_{IN}-V_{OUT}$) is commonly referred to as the "headroom" of the linear voltage regulator. In operation, linear voltage regulators generally operate in a step-down mode, in which the output voltage $V_{OUT}$ is stepped down from the input voltage (e.g., $V_{OUT}<V_{IN}$). The term "dropout" may refer to the minimum headroom value supported by a linear voltage regulator.

A low dropout (LDO) regulator is one type of linear voltage regulator that is popular in battery powered devices, in which the input voltage $V_{IN}$ dips to a level approximately equal, but still greater than the output voltage. AN LDO regulator (or LDO voltage regulator) is designed to provide a stable regulated output voltage rail in situations where the dropout of the voltage regulator is less than or equal to a predetermined minimum value. That is, a low dropout voltage regulator supports stable output voltage rail regulation when the difference between the input voltage $V_{IN}$ and a regulated output voltage $V_{OUT}$ is larger than or equal to the predetermined minimum value (e.g., 0.2 volts).

In operation, the LDO regulator may achieve higher power efficiency by lowering the power headroom, which may occur in battery powered devices as power is consumed. Lowering the power headroom, however, may lead to loop gain drop, which degrades performance by producing a poor power supply rejection ratio (PSRR), transient response, or the like. PSRR describes an amount of noise from a power supply that a particular device can reject.

To maintain high performance, some LDO implementations specify different minimum headroom values at different load current values. For example, the higher the load, the higher the specified headroom set based on the received power supply rail voltage of the LDO provided by a primary voltage regulator (e.g., an upstream buck regulator). The load may be a client device to which the LDO regulator supplies power. Although setting a constant and sufficiently high headroom across an entire range of load conditions may maintain LDO performance, this practice degrades power efficiency.

Some aspects of the present disclosure dynamically detect and set specified headroom for an LDO regulator at different loads to enable the LDO regulator to maintain high performance in conjunction with improved power efficiency. For example, an upstream voltage regulator may adaptively adjust an output voltage supplied to an input supply rail of a downstream LDO regulator based on an indication from the LDO regulator. The adaptively adjusted input voltage enables the downstream LDO regulator to achieve high performance and improved power efficiency across the entire range of load conditions.

In one aspect, an LDO headroom controller, includes circuitry (e.g., a tracking circuit) for tracking the operating conditions of a transistor of the LDO regulator (e.g., a power transistor) to dynamically detect a target operating condition and corresponding headroom for the LDO regulator for supplying power to a client device. In one aspect, the tracking circuit or portions of the tracking circuit may be integrated with the power transistor. The tracking circuit is useful for determining the target headroom of the power transistor while avoiding measurement of the input and output power transistor of the LDO regulator when current is running through the regulator.

The LDO headroom controller is coupled to or includes analog implementation circuits and/or digital implementation circuits. These implementation circuits may cause the primary regulator to set the input voltage of the LDO regulator based on an indication from the analog circuit or the digital circuit. For example, the indication may cause the primary regulator to increase/decrease the input voltage setting of the LDO regulator. The tracking circuit, the digital implementation circuit and/or the analog circuit may be included in the LDO regulator. Alternatively, one or more of the tracking circuit, the digital implementation circuit, and/or the analog circuit may be external, but coupled to the LDO regulator.

In one aspect of the present disclosure, the tracking circuit includes a pair of unbalanced input transistors to track operating conditions of a first transistor (e.g., a power field effect transistor) of the LDO regulator to determine or detect the minimum specified headroom of the first transistor. The detected minimum specified headroom for the first transistor corresponds to a difference between the input voltage (e.g., received power supply rail voltage from a primary regulator) and a regulated output voltage of the first transistor of the LDO regulator when the first transistor is operating at a first target operating condition. The operating condition of the first transistor is defined by a function of, or is determined based on, a size and other characteristics or parameters of the first transistor. For example, a size of the first transistor corresponds to a first channel width, W, and first channel length, L, of the first transistor. Some of the characteristics/parameters of the first transistor include charge carrier effective mobility ($\mu_n$) process parameters (e.g., the gate oxide capacitance per unit area or oxide thickness, $C_{ox}$, of the first transistor). The characteristics/parameters may also include a temperature, a load current of the LDO regulator, and various voltages of the first transistor. The various voltages may include a drain to source voltage (Vds), a gate to source voltage (Vgs), and a threshold voltage (Vth) for turning on the transistor.

The transistors described herein (e.g., a first transistor) may be implemented according to an n-channel or n-type configuration (e.g., n-channel metal oxide semiconductor field effect transistor (NMOS)) or p-channel configuration (PMOS). For illustrative purposes, however, some of the transistors described herein are NMOS transistors.

In one aspect, the noted pair of unbalanced transistors includes a second transistor and a third transistor that are configured to detect the target headroom of the first transistor during operation of the first transistor. The target headroom may be used by the digital implementation circuit and/or the analog implementation circuit to cause the primary voltage regulator to set a current input voltage of the first transistor of the LDO regulator. To detect the target headroom of the first transistor, the second and third transistors may be configured with similar characteristics and parameters as the first transistor.

Other parameters may be introduced to improve the detection of the minimum specified headroom of the first transistor with the tracking circuit. For example, one or more characteristics or parameters may be slightly adjusted (a multiplier is introduced) to align the function of the unbalanced transistors to the function corresponding to the first transistor when the first transistor operates at a target operating condition (e.g., a saturation region). For example, to create an imbalance between the second and third transistors, the second transistor may have a different size than the third transistor. The first transistor, which may be a power field effect transistor (FET) of the LDO, is of a larger size relative to the other transistors. For example, the second transistor may be a small fraction (e.g., 0.1%) of the size of the power FET. The second and third transistors may also have a similar mobility μn and process parameters (e.g., an oxide thickness (Cox)) as the first transistor. This configuration of the third and the second transistors achieves an offset voltage value that substantially equates to the target headroom of the first transistor under a target operating condition of the first transistor (e.g., when the first transistor is in a saturation region). The offset voltage value is a voltage difference between the second transistor and the third transistor when operating at a second target operating condition and a third target operating condition, respectively.

The tracking circuit includes an output node to provide the detected offset voltage value or detected headroom to the digital implementation circuit or the analog implementation circuit. The digital implementation circuit may include a digital controller coupled to a first node of the first transistor and a second node of the first transistor. The digital controller may receive the input voltage of the first transistor and the output voltage of the first transistor. The digital controller also compares the difference between a current input voltage and a current output voltage of the first transistor to the detected headroom/offset voltage value to obtain an offset indication corresponding to the difference in voltage. Power supplied by the first voltage regulator to a load (e.g., client device) may be adjusted based on the offset indication. For example, load current provided to the client device may be adjusted based on the offset indication. The power supplied to the client device may be increased by increasing the load current when the current power headroom (e.g., the difference between the current input voltage and the current output voltage) is smaller than the detected headroom.

In some aspects of the present disclosure, the digital controller provides the offset indication to the primary voltage regulator to cause the primary voltage regulator to adjust the input voltage of the first transistor based on the result of the comparison. For example, when the offset voltage value is larger than the difference between the input voltage and the output voltage of the first transistor, the indication causes the primary voltage regulator to increase the input voltage of the first transistor. Otherwise, when the offset voltage value is smaller than the difference between the input voltage and the output voltage of the first transistor, the indication causes the primary voltage regulator to reduce the input voltage of the first transistor. The input voltage level of the first transistor is maintained at a current level when the current voltage level and the difference between the input voltage level and the output voltage level of the first transistor are substantially the same. In some alternate implementations, the power supplied to the client device may be decreased by decreasing the load current when the current power headroom is greater than the detected headroom.

In one aspect of the present disclosure, the analog circuit may be implemented as an analog feedback loop or as part of an analog feedback loop. The analog feedback loop may include a first amplifier, a second amplifier, a first transistor, and a voltage adjusting circuit (e.g., a current sinking circuit). The voltage adjusting circuit may be configured to cause the primary voltage regulator to adjust the input voltage of the first transistor or to provide an offset indication for causing power supplied to the client device to be adjusted. For example, the power supplied to the client device may be adjusted by adjusting the load current or voltage to the client device. In some implementations, the load current or voltage may be adjusted (e.g., by a control device) based on the offset indication.

In operation, the output voltage of the first transistor is received at a first input of the first amplifier. The first amplifier adds the offset voltage value defined by the tracking circuit to the output voltage of the first transistor to obtain the desirable or target input voltage of the first transistor at the output of the first amplifier. Thus, the input voltage is forced to equal to the target input voltage at the output of the first amplifier without using a comparator.

For example, a portion of or all of the tracking circuit (including the pair of unbalanced input transistors or unbalanced, dynamically-biased differential pair) may be integrated in the power FET. In one aspect of the present disclosure, the detected offset voltage value may be provided to the first amplifier. For example, the detected offset voltage value provided to the first amplifier is equal to the saturation voltage, vdsat, of the power FET of the LDO regulator. Thus, the detected offset voltage value tracks the saturation voltage of the power FET. The first amplifier implemented according to a unity gain configuration (e.g., unity-gain buffer), such that one input of the first amplifier is connected to the output of the LDO regulator (Vout_LDO). Accordingly, the output of first amplifier is equal to the output of the LDO regulator plus the detected offset voltage value of the first amplifier (Vout_LDO+vdsat), which is the target or ideal input voltage of the LDO regulator. This value is used as the reference in an analog implementation to adjust voltage provided from a primary or upstream regulator to the LDO or downstream regulator. For example, the upstream regulator output may be regulated to equal the target value.

The target input voltage is the input voltage determined based on the headroom detected to power the LDO regulator. The target input voltage may not match the current input voltage of the LDO regulator causing the LDO regulator to be inefficient or underperform. To mitigate the inefficiency, the target input voltage and the current input voltage of the first transistor are respectively provided to a first input and a second input of the second amplifier (e.g., a high gain amplifier). The second amplifier amplifies the difference between the target input voltage and the current input voltage and the result at a first output of the second amplifier is provided to the voltage adjusting circuit.

For example, a voltage adjusting circuit may cause an indication voltage at an input voltage indication node to be adjusted. The primary voltage regulator may then adjust the voltage provided to the LDO regulator based on the indication voltage. For example, the primary voltage regulator increases the voltage provided to the LDO regulator through the input voltage indication node when the indication voltage is low. In addition, the primary voltage regulator decreases the voltage provided to the LDO regulator through the input voltage indication node when the indication voltage is high. Alternatively, the primary voltage regulator maintains the voltage provided to the LDO regulator through the input voltage indication node when the indication voltage is maintained.

Accordingly, aspects of the present disclosure detect and maintain headroom of an LDO regulator to compensate and ensure that the LDO regulator provides a well-regulated output supply rail. This feature may be implemented by using a tracking circuit for headroom detection that tracks a load current, a performance, a voltage and temperature. The tracking circuit is process independent and supports independent detection of voltage and temperature biases. For example, the tracking circuit operates such that a function (e.g., equation (1)) corresponding to the offset of the unbalanced transistors (e.g., the second and the third transistor) and a threshold of a linear/saturation region of the powerFET (e.g., equation (3)) are substantially equal. The relationship between the offset and the threshold of the linear/saturation region of the powerFET is independent of process parameters, temperature, etc.

A closed-loop feedback implementation (analog or digital) causes the primary voltage regulator to change its output voltage (LDO input voltage) to provide improved headroom for the LDO regulator. Thus, the implementation supports high performance of the LDO regulator with improved system efficiency. Aspects of the present disclosure also simplify software control of the primary voltage regulator and the LDO regulator. For example, a software implementation may be used to set downstream load voltage (e.g., load voltage of the primary voltage regulator) while an improved upstream regulator voltage (e.g., the LDO regulator input voltage) may be set according to aspects of the present disclosure.

System Overview

FIG. 1 depicts a system 100 for delivering power in an electronic device according to one aspect of the present disclosure. The system 100 includes a battery 102 that may provide a power supply voltage from outside a chip including a voltage regulator (e.g., regulator 104). The regulator 104 may deliver a power supply voltage (e.g., a voltage rail) from the battery 102 to different subsystems 106. Also, external subsystems 108 may be located external to the chip that includes the regulator 104. The external subsystems 108 may not draw power from the regulator 104, but may still draw power from the battery 102.

The system 100 may be part of an electronic device, such as a cellular phone, tablet, or other mobile device. In one aspect, the regulator 104 is highly integrated in the electronic device with the subsystems 106 and the external subsystems 108. In one aspect, the regulator 104 may be a buck regulator, a boost regulator, and/or a buck-boost regulator. The regulator 104 regulates the output voltage Vout from the regulator 104 to different subsystems 106. For example, in boost mode, the regulator 104 may increase the level of an input voltage Vin that is received from the battery 102. Also, in buck mode, the regulator 104 may decrease the level of the input voltage Vin that is received from the battery 102.

The system 100 includes subsystems 106 (e.g., loads) that draw power from the regulator 104. These subsystems 106 may include different minimum power supply voltage specifications. For example, the minimum operating voltage may be a level below which the subsystems may no longer operate properly. The subsystems 106 may draw different levels of power (e.g., current and/or voltage) at different times depending on the operations the subsystems are performing. Further, different subsystems may draw power at different times, such as a subsystem may draw power when actively performing an operation, but not draw a lot of power when idle. For example, an electric flash on a camera may draw a large current for a short time when the flash is operated, a WiFi or cellular subsystem may draw a large current during transmission, or a computer processor may draw a large current while processing a large instruction block.

In a highly-integrated system, such as a mobile phone or tablet computer, the power delivery capability of the regulator 104 is limited by the power available from the battery 102. Under certain conditions, the regulator 104 may not be able to provide sufficient power to meet all the demands of the subsystems 106. When the power specified for multiple subsystems increases past the available power, the power supply voltage at the output of the regulator 104 may droop, causing one or more subsystems 106 to fail.

Sensor logic 110 and Vout control logic 112 may be provided to adjust the output voltage Vout such that the regulator 104 is able to provide sufficient power to subsystems 106. In one aspect, sensor logic 110 and Vout control logic 112 may be part of the regulator 104. As will be discussed in more detail below, the sensor logic 110 monitors power in the electronic device and uses multiple thresholds to determine when to increase or decrease the output voltage Vout of the regulator 104. The thresholds may be set below an absolute limit threshold in which the electronic device may not operate properly if the absolute limit is met. Vout control logic 112 controls the output voltage Vout by increasing or decreasing the output voltage in increments. The output voltage Vout may only be decreased to the minimum voltage level or increased to a maximum voltage level. These levels are based on voltage levels requested from a set of subsystems and priority levels associated with those subsystems. These concepts will now be described in more detail.

Figure 2:
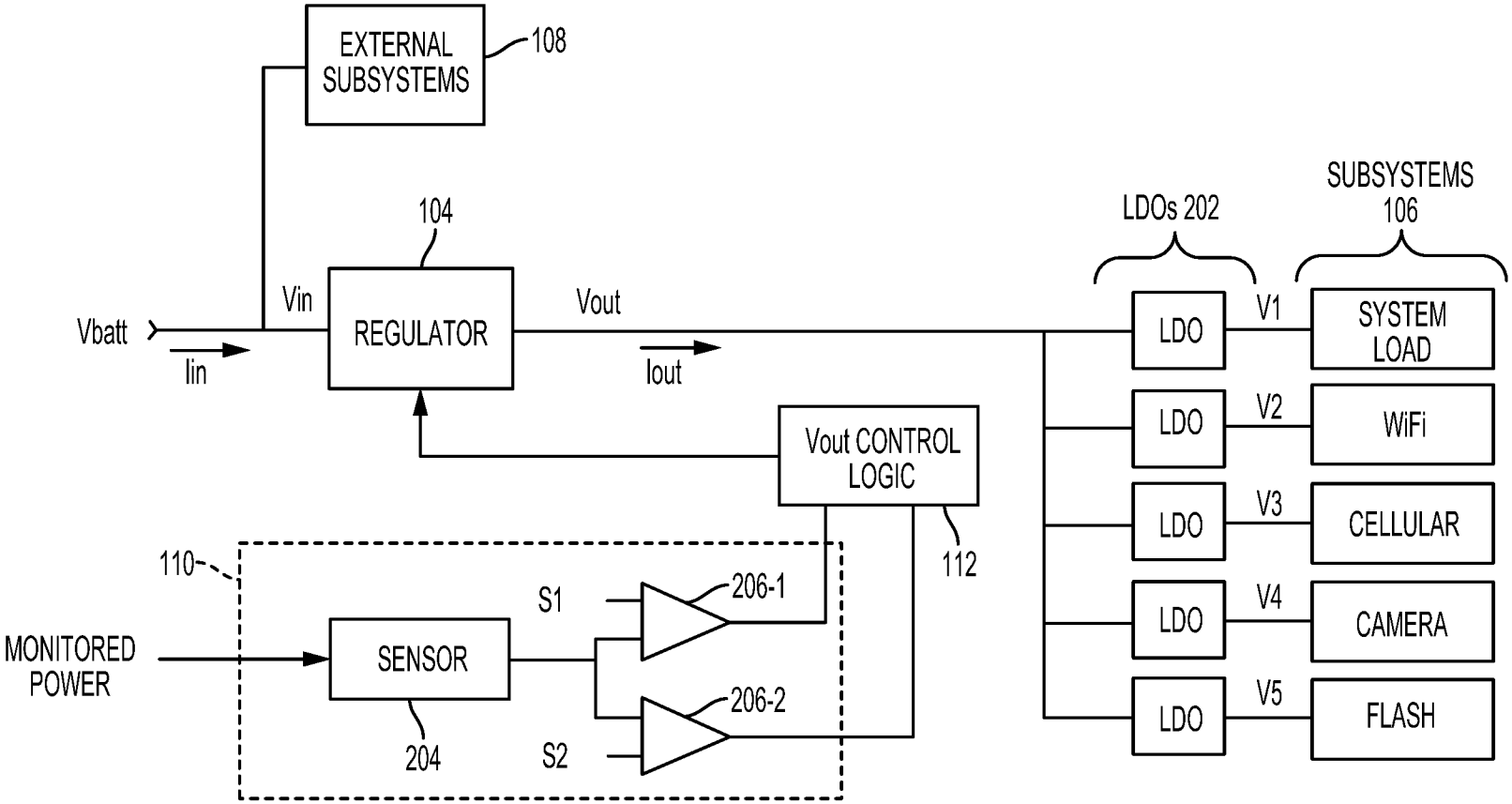
FIG. 2 depicts a more detailed example of the system according to one aspect of the present disclosure.

FIG. 2 depicts a more detailed example of the system 100. In this example, an implementation of sensor logic 110 is shown, but it will be recognized that other implementations are possible. For example, the sensor logic 110 may be implemented in analog circuits, digital circuits, and/or software.

The regulator 104 receives a battery voltage Vbatt (or current Iin) from the battery 102, and provides an output voltage Vout (or current Iout) to low drop-out (LDO) regulators 202 that customize the internal power supply voltage to each of the subsystems 106. For example, a system load may specify a voltage V1, a WiFi subsystem may specify a voltage V2, a cellular subsystem may specify a voltage V3, a camera subsystem may specify a voltage V4, and a flash subsystem may specify a voltage V5. These voltages may be the minimum voltage specified for the subsystems to operate properly. For example, if the output voltage drops below this level, a subsystem may experience decreased performance. However, in some cases, the subsystem may not experience a total failure.

Each of these subsystems may be assigned a priority from multiple different priorities. For example, a first higher priority is defined as a "priority level 1" and a second lower priority is defined as a "priority level 0". The minimum and maximum output voltage Vout levels of the regulator 104 are generated based on the priorities and the power supply voltages being requested by subsystems 106. For example, a minimum allowable Vout level is defined by the requested power supply voltages of subsystems 106 that are designated as "priority level 1."

In one example, the WiFi subsystem may specify 3.6 V to operate properly, but others of the subsystems 106, such as the system load, may specify only 3.3 V. WiFi may be designated as a low priority load and assigned the priority level 0 and the system load is designated as a high priority level 1. In this case, during high power loading, it may be acceptable to reduce the power supply output voltage Vout to be lower than 3.6 V (the level requested by WiFi), but not less than 3.3 V (the level requested by the system load). This reduced voltage may reduce the performance of the WiFi subsystem, but the user impact might be minimal. In this case, as long as the power supply voltage is above 3.3 V, the priority level 1 subsystems 106 may operate properly, but the WiFi subsystem may possibly operate with a reduced performance. WiFi is considered a lower priority and the reduced performance is tolerated and may not noticeably impact a user of the electronic device. At the expense of reduced performance of the WiFi subsystem, a shutdown of any subsystem or the entire electronic device may be avoided.

Sensor logic 110 includes a sensor 204 that monitors the power from one or more locations in the electronic device. The locations may be at the input of the regulator 104, the output of the regulator 104, within the regulator 104, the output of the battery 102, and the input of external subsystems 108. In one aspect, the sensor 204 monitors the input current through the regulator 104, such as through an inductor of the regulator 104. In other examples, either the current or the voltage output by the battery 102 or input to external subsystems 108 may be monitored.

Comparison logic shown as a first comparator 206-1 and a second comparator 206-2 receives the monitored power and can compare the monitored power to different thresholds. For example, the first comparator 206-1 compares the power to a first threshold S1 and the second comparator 206-2 compares the power to a second threshold S2. The first threshold S1 and the second threshold S2 may be early warning levels that control the automatic adjustment of the output voltage of the regulator 104. A third absolute threshold Lim may be an absolute threshold in which the system may stop operating properly if the power goes above this limit. In this case, the electronic device or a subsystem may need to be shut down or other undesirable measures taken. In one example, the thresholds may be current thresholds if current is being monitored, such as the first threshold S1 is 3.5 A, the second threshold S2 is 3 A, and the absolute threshold Lim may be 4 A. Other thresholds may also be used, such as power or voltage thresholds. That is, the absolute threshold Lim is above the threshold S1, which is above the threshold S2. By providing the other thresholds S1 and S2, the Vout control logic 112 may adjust the output voltage Vout of the regulator 104 such that the threshold Lim may not be reached. This may avoid an undesirable shutdown of components of the electronic device.

When the monitored power meets the first threshold S1 (is equal to and/or above), the first comparator 206-1 outputs a signal, such as a "high" signal to the Vout control logic 112. Also, when the monitored power meets the second threshold S2 (e.g., is equal to or below); the second comparator 206-2 outputs a high signal to the Vout control logic 112. Conversely, when the power goes below the first threshold or above the second threshold, the comparators 206-1 and 206-2, respectively, output a "low" signal to Vout control logic 112.

When threshold S1 is met, the Vout control logic 112 may send a signal to the regulator 104 to step the output voltage Vout down an increment. The increment may be preset and may be around 32 millivolt (mV)/6 microseconds (μs). When the threshold S2 is met, then Vout control logic 112 may output a signal to the regulator 104 to increase the output voltage by an increment, such as by the same 32 mV/6 μs increment. Each time one of the thresholds is met, then Vout control logic 112 may signal the regulator 104 to adjust the output voltage by another increment. In one aspect, once the threshold is hit and goes above or below the threshold, the signal should be cleared before it can be met again. In other aspects, at every clock cycle, the power is checked, and if one of the thresholds is met, the signal is asserted again.

Figure 3:
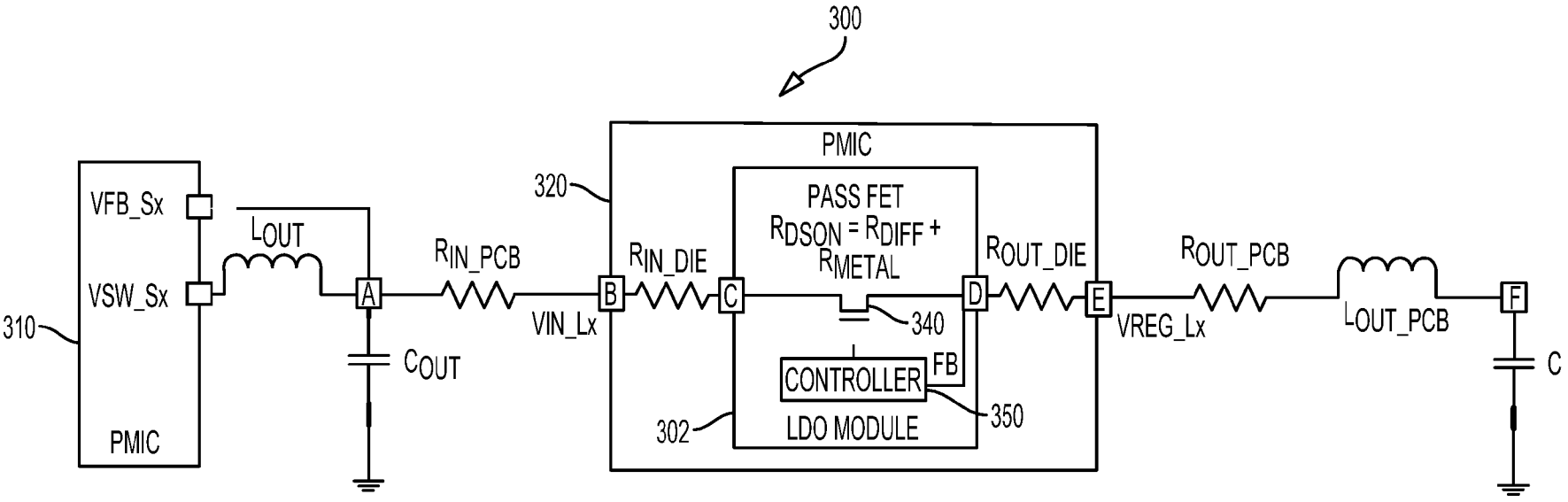
FIG. 3 illustrates an exemplary implementation for controlling headroom of a low dropout (LDO) regulator according to aspects of the present disclosure.

FIG. 3 illustrates an exemplary implementation for controlling headroom of a low dropout (LDO) regulator. The LDO regulator may be implemented as part of a power management module (e.g., power management integrated circuit (PMIC)). One way to control headroom of an LDO regulator is by an open loop implementation using software. In this implementation, the headroom of the LDO regulator is determined by measuring an input voltage at a first input node of the power management module and measuring an output voltage at a first output of the power management module and determining the difference between the input voltage and the output voltage. In some configurations, the actual input voltage of the LDO regulator is inaccessible or cannot be measured or tracked directly during operation or when the power transistor of the LDO regulator is carrying current. As a result, actual headroom of the LDO regulator cannot be determined during operation. For example, the implementation cannot accurately mitigate voltage drop (V=current multiplied by resistance (IR)) due to parasitic elements (e.g., resistors and inductors) from the LDO regulator input to a load. Although load line compensation may mitigate this issue, the load line compensation further exacerbates the LDO headroom. This implementation also suffers from load current dependent LDO headroom.

An exemplary block diagram of a system 300 for the open loop implementation with software is illustrated in FIG. 3. The system 300 includes the primary voltage regulator 310 in a first power management integrated circuit (PMIC), a second power management integrated circuit (PMIC) 320, an LDO module 302 in the PMIC 320, an LDO controller 350, a power transistor 340 of the LDO module 302, a low pass filter including an inductor ($L_{out}$) and a capacitor ($C_{out}$), parasitic resistances ($R_{in_PCB}$ and $R_{out_PCB}$) of a printed circuit board (PCB) supporting the primary voltage regulator 310 and the PMIC 320, parasitic inductance ($L_{out_PCB}$) of the PCB, and parasitic resistances ($R_{in_die}$ and $R_{out_die}$) of the die on which the PMIC 320 is fabricated. The system 300 also includes input and output nodes of the PMIC 320 (e.g., nodes B and E), input and output nodes of the LDO module 302 (e.g., nodes C and D). The system 300 also includes an output capacitor, C, at an output node, F. The output capacitor, C, maintains loop stability and keeps an output voltage of the LDO module 302 relatively constant. For example, the output capacitor, C, keeps the output voltage of the LDO module 302 relatively constant during load transients.

As noted, because the input node, C, and the output node, D, of the LDO module 302 are inaccessible, the headroom of the LDO module 302 cannot be accurately detected. As a result, a less accurate determination of the headroom is achieved based on measuring input voltage at a first input node, B of the power management module, such as the PMIC 320 and measuring an output voltage at a first output node, E, of the PMIC 320 and determining the difference.

Figure 4:
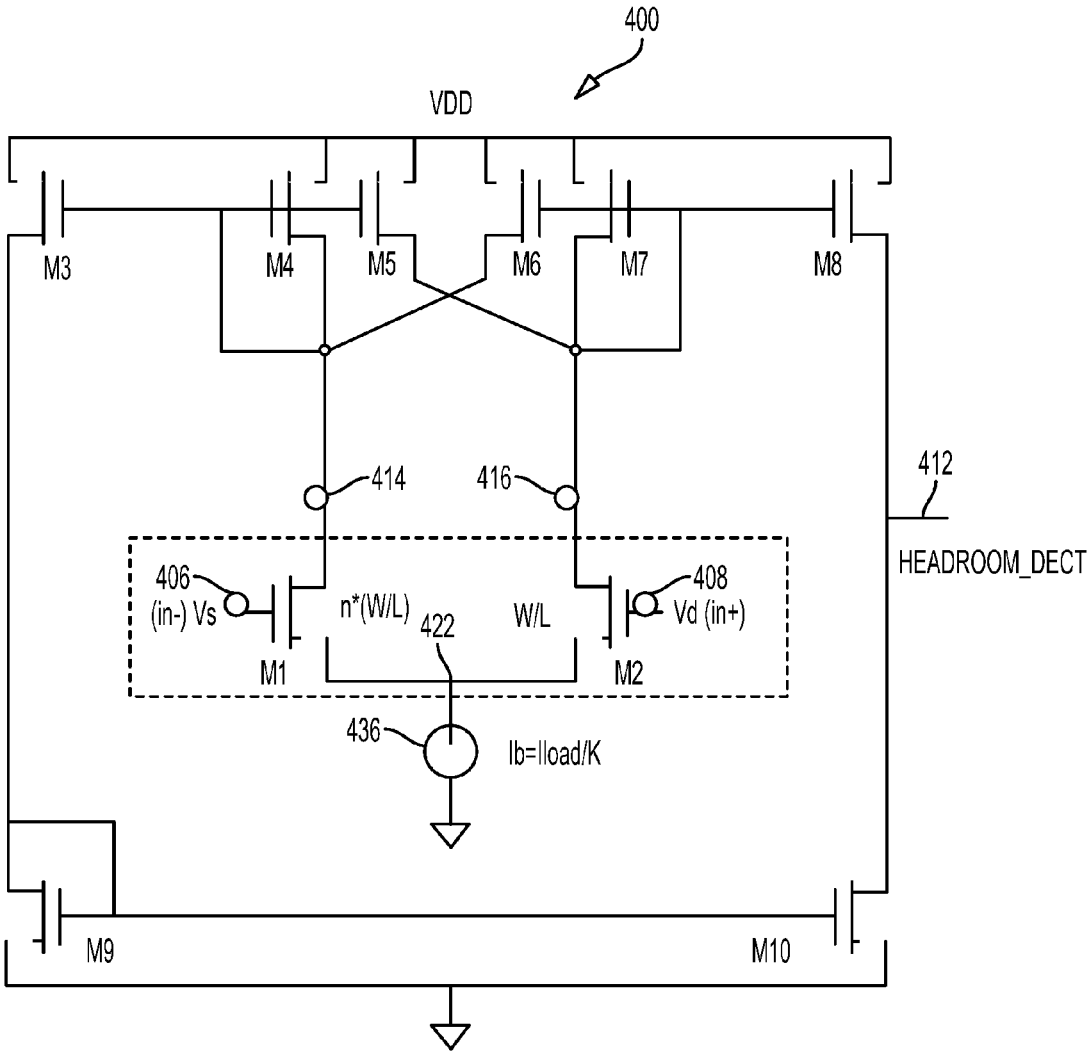
FIG. 4 shows an exemplary circuit for tracking operating conditions of a transistor of a low dropout (LDO) regulator according to aspects of the present disclosure.

FIG. 4 shows a tracking circuit 400 for tracking operating conditions of a transistor of an LDO regulator according to aspects of the present disclosure. The circuit 400 may be implemented as a comparator or part of a comparator and integrated in whole or part of the LDO regulator. For example, the tracking circuit may be integrated in a power field effect transistor of the LDO regulator. The circuit 400 includes a set of supporting transistors (M3, M4, M5, M6, M7, M8, M9, and M10), and a pair of unbalanced input transistors (M1 and M2) to track operating conditions of a first transistor (e.g., a power field effect transistor (pwrFET)) of the LDO regulator to determine or detect the headroom of the first transistor. The transistor M1 includes a first node 414 corresponding to a drain of the transistor M1, a second node 406 corresponding to a gate of the transistor M1 and a third node 422 corresponding to a source of the transistor M1. The transistor M2 includes a first node 416 corresponding to a drain of the transistor M2, a second node 408 corresponding to a gate of the transistor M2 and a third node 422 corresponding to a source of the transistor M2. The circuit 400 also includes a current source 436 to dynamically bias the pair of unbalanced transistors, M1 and M2, with a small fraction of load current, Iload/K, of the first transistor. The circuit 400 further includes an output node 412 to provide an output (headroom detect signal) corresponding to a comparison between a target input voltage of the transistor of the LDO regulator and a current input voltage of the LDO regulator. The target input voltage may be the sum of the offset voltage value or detected headroom of the first transistor and the current output voltage of the transistor of the LDO regulator. The comparator may be applied to the digital implementation circuit or the analog implementation circuit for further implementation.

The circuit 400 is achieved based on a relationship between a drain current of a MOS transistor (e.g., the first transistor) and a drain-to-source voltage of the transistor when the transistor operates in a saturation region. In the saturation region, the first transistor is turned on, and a channel has been created, which allows current to flow between the drain and source. Because the drain voltage is higher than the source voltage, the electrons spread out, and conduction is not through a narrow channel but through a broader, two- or three-dimensional current distribution extending away from the interface and deeper in a substrate. For example, when the transistor operates in the saturation region, the drain current (e.g., load current) of the transistor is substantially independent of the drain-to-source voltage of the transistor. In the saturation region the drain-to-source voltage, Vds, is greater than a difference between a gate-to-source voltage of the first transistor and a threshold voltage, Vth, for turning on the first transistor. The drain-to-source voltage for the saturation region is modeled as in equation 1:

$$Vds > Vgs - Vth = Vdsat = \sqrt{\frac{2 \cdot Iload}{\mu_n C_{ox}\left(\frac{W}{L}\right)_{pwrFET}}} \tag{1}$$

where Vds is a drain-to-source voltage, Vgs is a gate-to-source voltage, Vth is a threshold voltage, Vdsat is the saturation voltage when the pwrFET is in the saturation region, Iload is a load current, $\mu_n$ is a charge carrier effective mobility, $C_{ox}$ is the gate oxide capacitance per unit area or oxide thickness (e.g., power FET (pwrFET)), W is a channel width of the pwrFET, and L is a channel length of the pwrFET.

The first transistor is in a linear region when the drain-to-source voltage, Vds, is less than the difference between the gate-to-source voltage of the first transistor and the threshold voltage, Vth, for turning on the first transistor. In the linear region, the first transistor is turned on, and a channel has been created that allows current to flow between the drain and the source. The transistor operates like a resistor, controlled by the gate voltage relative to both the source and drain voltages. The drain-to-source voltage for the linear region is modeled as in equation 2:

$$Vds < Vgs - Vth = Vdsat = \sqrt{\frac{2 \cdot Iload}{\mu_n C_{ox}\left(\frac{W}{L}\right)_{pwrFET}}} \tag{2}$$

An offset voltage value for the comparator with the unbalanced input pair may be modeled as in equation 3:

$$Voffset = Vgs1 - Vgs2 = \sqrt{\frac{2 \cdot I_D}{\mu_n C_{ox}\left(\frac{W}{L}\right)_{input}}} + Vth - \sqrt{\frac{2 \cdot I_D}{n \cdot \mu_n C_{ox}\left(\frac{W}{L}\right)_{input}}} - Vth = \sqrt{\frac{I_b}{\mu_n C_{ox}\left(\frac{W}{L}\right)_{input}}} \cdot \left(1 - \frac{1}{\sqrt{n}}\right) \tag{3}$$

where Vgs1 is a gate to source voltage for transistor M1, Vgs2 is a gate to source voltage of transistor M2, $I_D$ is a drain current, Ib is a bias current for the comparator, which is a function of the drain current or load current, and n is a multiplier to create imbalance between the transistor M1 and the transistor M2.

The offset value modeled for the comparator in equation 3 is similar to the saturation voltage Vdsat or Vds in the saturation region when the comparator is biased dynamically with the load current, Iload, of the transistor (pwrFET) of the LDO regulator, as shown in equation 4:

$$Ib = Iload/K \tag{4}$$

where K is a constant.

The offset value modeled for the comparator in equation 3 is similar to the saturation voltage Vdsat or Vds in the saturation region when the comparator unbalanced input pair is designed using a same type of device as the transistor of the LDO regulator, and sized as shown in equation 5: (where K is the same constant shown in equation 4)

$$\left(\frac{W}{L}\right)_{input} = \left(\frac{W}{L}\right)_{pwrFET} \Big/ 8K \tag{5}$$

Taking n=4, for example, and applying equations 4 and 5 to equation 3, the offset voltage value of the comparator is equivalent to the saturation voltage of the transistor of the LDO regulator, as shown in equation 6:

$$Voffset = \sqrt{\frac{2 \cdot Iload}{\mu_n C_{ox}\left(\frac{W}{L}\right)_{pwrFET}}} = Vdsat \tag{6}$$

Accordingly, the offset voltage value of the comparator tracks the saturation voltage, $V_{dsat}$, of the power transistor of the LDO regulator when the comparator is biased with dynamic load current of the power transistor of the LDO regulator, and the transistors (e.g., M1 and M2) are sized as illustrated. The saturation voltage $V_{dsat}$ is equal to or smaller than Vds when the transistor of the LDO regulator is in the saturation region. Vds is equal to Vd−Vs, which is the difference between the input voltage and the output voltage of the transistor of the LDO regulator or the headroom for the transistor of the LDO regulator. Thus, the comparator tracks the minimum specified headroom of the transistor of the LDO regulator.

Figure 5:
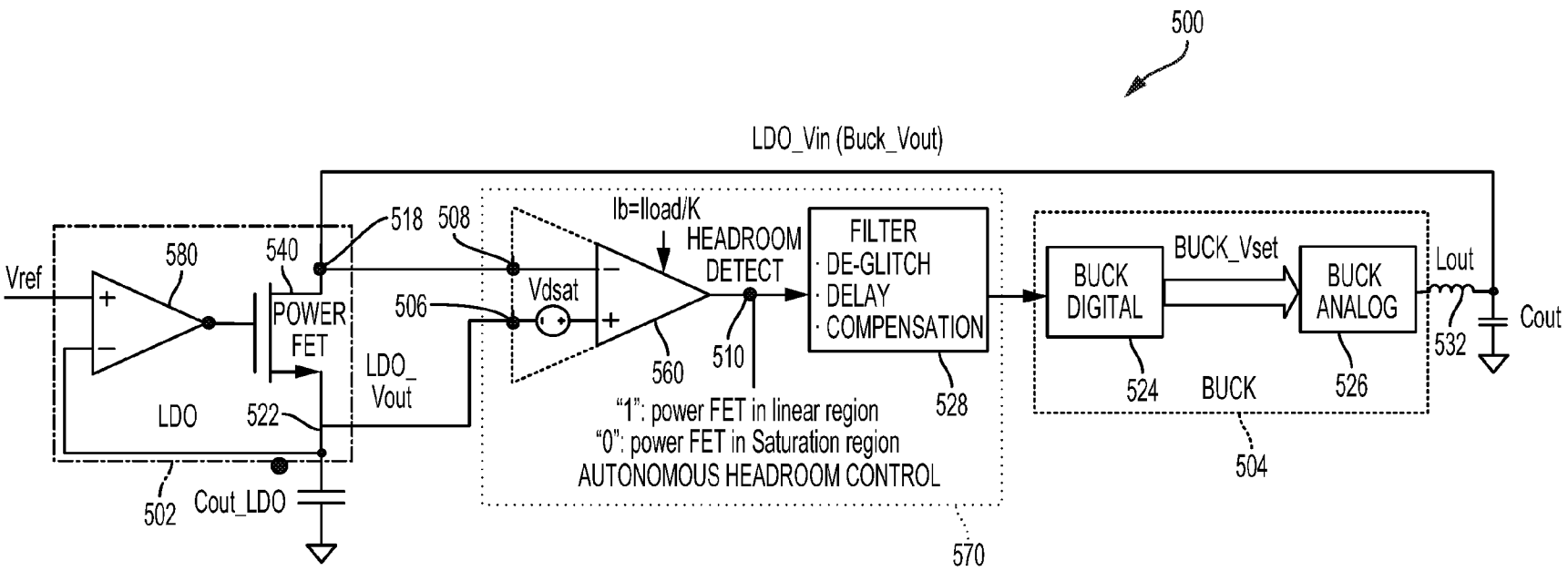
FIG. 5 shows an exemplary digital implementation for controlling headroom of a low dropout (LDO) regulator based on the tracked operating conditions according to aspects of the present disclosure.

FIG. 5 shows an exemplary digital implementation for controlling headroom of an LDO regulator based on the tracked operating conditions according to aspects of the present disclosure. FIG. 5 includes a digital implementation circuit 500, which includes an LDO regulator 502, a digital controller 570 (e.g., for automated headroom control), a primary voltage regulator 504 (upstream), and a filter 532 including an inductor (Lout) and a capacitor (Cout). The LDO regulator 502 includes a transistor 540 having a drain node 518 to provide the input voltage of the transistor 540 and a source node 522 to provide the output of the transistor 540. The LDO regulator 502 also includes an amplifier 580 forming a feedback loop adapted to control a direct current accuracy of the LDO regulator 502. Reference voltage, Vref, and feedback from the voltage output of the amplifier 580 are applied to inputs of the amplifier 580.

The digital controller 570 includes a comparator 560 and a filter 528. For example, the comparator may include the tracking circuit 400 of FIG. 4. The filter 528 provides compensation for de-glitching, delaying and/or other compensation such as feedback loop compensation for the headroom detect signal. The headroom detect signal or indication at an output node 510 of the comparator 560 is compensated by the filter prior to providing the headroom detect signal to the primary voltage regulator 504. The primary voltage regulator 504 may include analog and digital devices 524 and 526.

The digital controller 570 generates the headroom detect signal and provides the headroom detect signal to the primary voltage regulator 504 to cause the primary voltage regulator 504 to set the input voltage of the transistor 540 of the LDO regulator 502 through a feedback loop from the output of the primary voltage regulator 504 to the input of the LDO regulator 502. For example, the headroom detect signal causes the primary voltage regulator 504 to increase or decrease the input voltage setting for the LDO regulator 502.

The inputs (508 and 506) of the comparator 560 of the digital controller 570 are respectively coupled to a first node (e.g., drain node 518) of the transistor 540 and a second node (e.g., source node 522) of the transistor 540 to respectively receive the input voltage and the output voltage of the transistor 540. The comparator 560 compares the target input voltage for the transistor 540 of the LDO regulator 502 and the current input voltage of the transistor 540. The target input voltage is the sum of the current output voltage of the transistor 540 and the detected offset voltage value determined according to the circuit 400 for tracking operating conditions of a transistor of a low dropout (LDO) regulator illustrated in FIG. 4. The detected offset voltage value tracks the saturation voltage (Vdsat) of the transistor 540.

The digital controller 570 then generates the headroom detect signal or indication to the primary voltage regulator 504 to cause the primary voltage regulator 504 to adjust the input voltage of the transistor 540 based on the result of the comparison. For example, when the detected offset voltage value is larger than the difference between the input voltage and the output voltage of the transistor, the indication causes the primary voltage regulator 504 to increase the input voltage of the transistor 540 through the feedback loop. Otherwise, when the detected offset voltage value is smaller than the difference between the input voltage and the output voltage of the transistor 540, the indication causes the primary voltage regulator 504 to reduce the input voltage of the transistor 540. The input voltage of the transistor 540 is maintained at a current value when the detected offset voltage value and the difference between the input voltage and the output voltage of the transistor 540 are substantially the same.

Thus, if the target input voltage is larger than the input voltage of the transistor, the headroom detect signal causes the primary voltage regulator 504 to increase the input voltage of the transistor 540 through the feedback loop. If the target input voltage is smaller than the input voltage of the transistor, the headroom detect signal causes the primary voltage regulator 504 to decrease the input voltage of the transistor 540 through the feedback loop. In some aspects of the present disclosure, the headroom detect signal is a digital high (e.g., 1) or digital low (e.g., 0).

Figure 6:
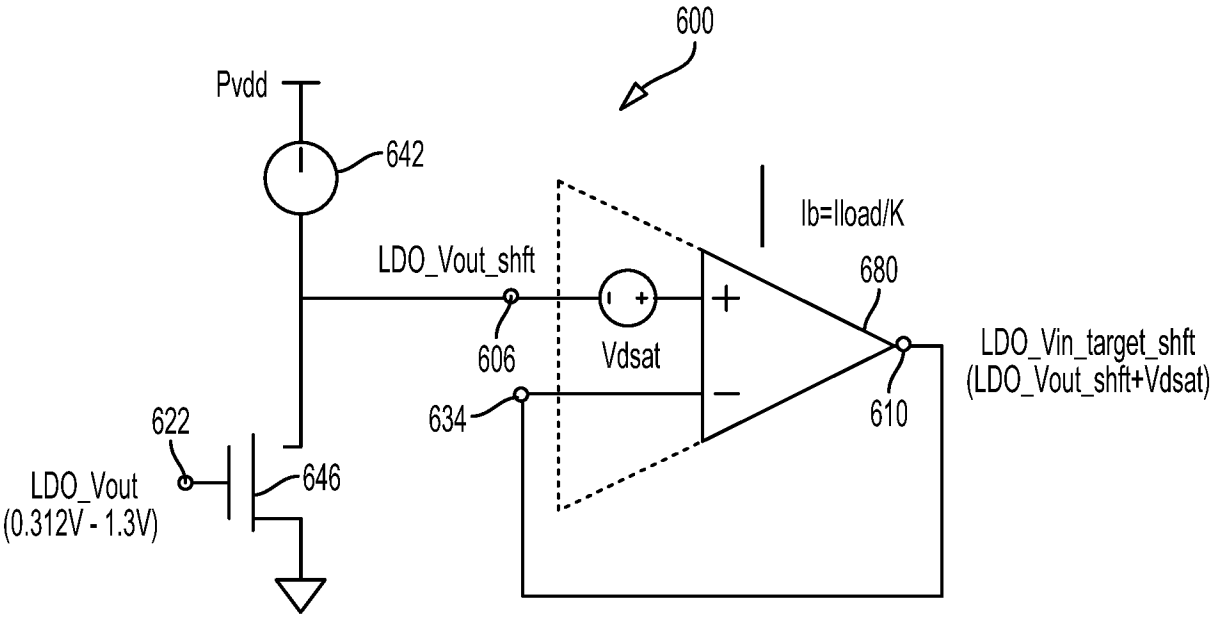
FIG. 6 shows an exemplary analog implementation for controlling headroom of a low dropout (LDO) regulator based on the tracked operating conditions according to aspects of the present disclosure.

FIG. 6 shows an exemplary analog implementation for controlling headroom of an LDO regulator based on the tracked operating conditions according to aspects of the present disclosure. An analog implementation circuit 600 includes a first buffer circuit including a transistor 646 and a current source 642. A gate 622 of the transistor 646 receives an output voltage of an LDO regulator (e.g., LDO regulator 502) and the output voltage of the LDO regulator is buffered by the first buffer. In some implementations, the first buffer may be optional. A buffered output voltage of the LDO regulator is then provided to a first input 606 of an amplifier 680. The amplifier 680 may include the tracking circuit 400. The amplifier 680 may be biased by an adjusted load current (e.g., a fraction of the load current (Iload/K)) of the LDO regulator. The amplifier 680 forms a feedback loop adapted to feedback an output voltage at an output voltage node 610 of the amplifier 680 to a second input 634 of the amplifier 680.

In this arrangement, the offset voltage value or detected minimum specified headroom (e.g., Vdsat) at the amplifier 680 is added to the output voltage of a transistor of the LDO regulator at the first input 606 of the amplifier 680 to obtain target or ideal input voltage for the LDO regulator. An indication of the target input voltage is then forwarded to the primary voltage regulator (e.g., primary voltage regulator 504) to cause the primary voltage regulator to adjust the input voltage of the transistor of the LDO regulator.

Figure 7:
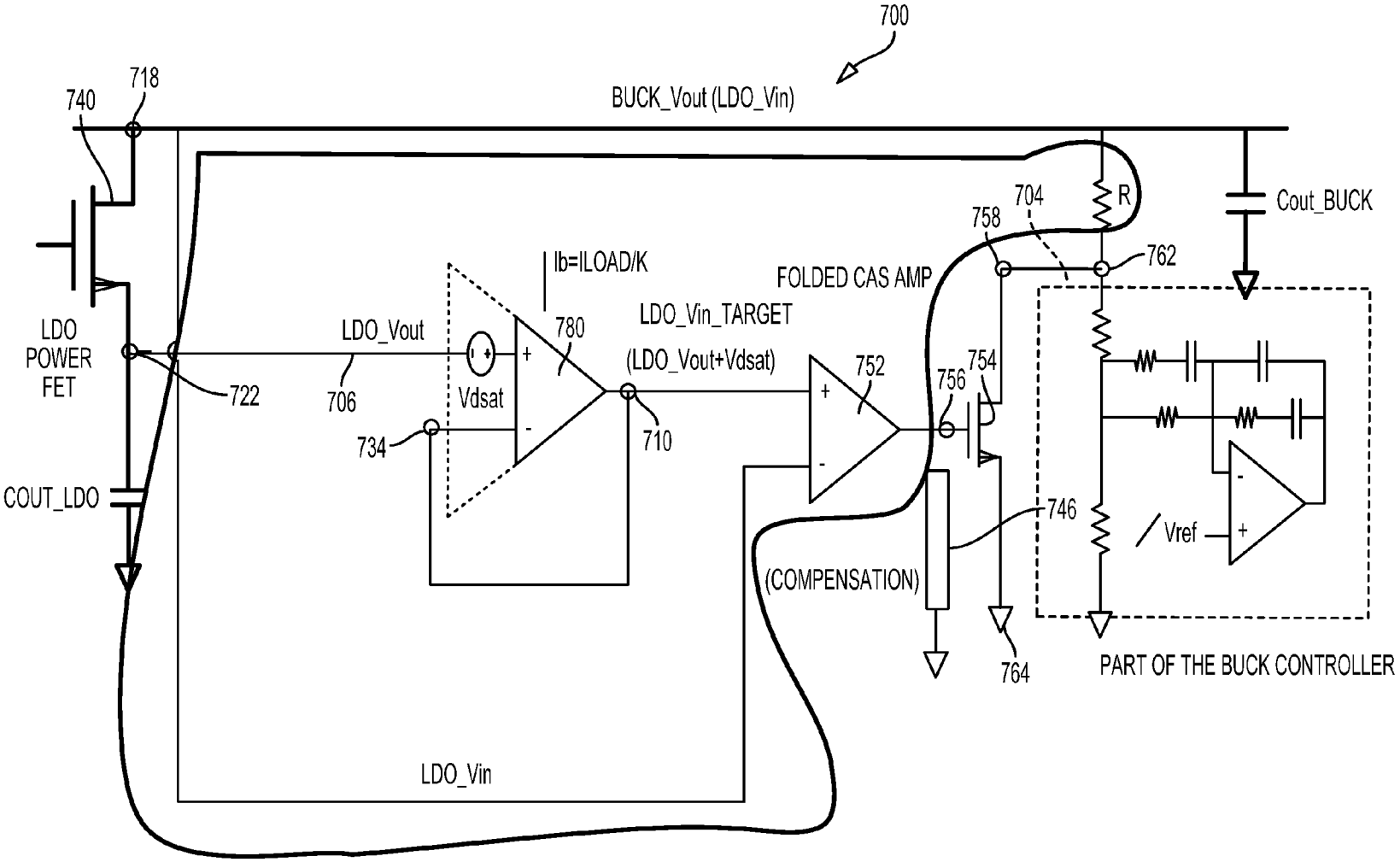
FIG. 7 shows another exemplary analog implementation for controlling headroom of a low dropout (LDO) regulator based on the tracked operating conditions according to aspects of the present disclosure.

FIG. 7 shows another exemplary analog implementation for controlling headroom of a low dropout (LDO) regulator based on the tracked operating conditions according to aspects of the present disclosure. The analog implementation circuit 700 includes a transistor 740 of an LDO regulator. The transistor 740 includes a transistor input node 718 where an input voltage of the transistor is received and an output node 722 to output the output voltage of the transistor 740. The output voltage of the LDO regulator is provided to a first amplifier 780 (at input 706). The first amplifier 780 is similar to the amplifier 680 of FIG. 6, which provides the target input voltage of the transistor 740 of the LDO regulator. The target input voltage of the transistor is a sum of the detected offset voltage value and the current output voltage of the transistor 740. The first amplifier 780 is biased by an adjusted load current (e.g., a fraction of the load current (Iload/K) of the transistor of the LDO regulator. The first amplifier 780 forms a feedback loop adapted to feedback output voltage of the first amplifier 780 to an input 734 of the first amplifier 780. The analog implementation also includes a second amplifier 752 coupled to a voltage adjusting circuit (e.g., a current sinking circuit). The voltage adjusting circuit may include a compensation circuit. The compensation circuit and the voltage adjusting circuit may be coupled to a primary voltage regulator 704, and a resistor R.

The analog implementation circuit 700 may be implemented as an analog feedback loop. The analog feedback loop may include the first amplifier 780, the second amplifier 752, and the transistor 740 of the LDO regulator. In this arrangement, the voltage adjusting circuit causes the primary (or upstream) voltage regulator 704 to adjust the input voltage of the transistor 740. In operation, the output voltage of the transistor 740 is received at a first input of the first amplifier 780. The first amplifier adds the offset voltage value (=Vdsat) defined by the tracking circuit to the output voltage of the transistor 740 to obtain the target input voltage for the transistor 740 at an output 710 of the first amplifier 780. The first amplifier 780 may be implemented according to a unity gain configuration to automatically provide the target input voltage of the transistor 740 of the LDO regulator.

The target input voltage from the first amplifier 780 and the current input voltage of the transistor 740 are respectively provided to a first input and a second input of the second amplifier 752 (e.g., a high gain amplifier). The second amplifier 752 introduces a gain to the difference between the target input voltage and the current input voltage. The second amplifier 752 then provides an output of the amplified difference between the target input voltage and the current input voltage to the voltage adjusting circuit. The output of the second amplifier 752 may be coupled to an input node 756 of the voltage adjusting circuit. The voltage adjusting circuit may include the transistor 754 having the input node 756 at a gate of the transistor 754. Compensation device, 746, may also be introduced at the node 756 to provide compensation for the resultant signal at the output of the second amplifier 752.

A drain node 758 of the voltage adjusting circuit may be coupled to an input voltage indication node 762. The primary voltage regulator includes circuitry that detects or monitors an indication voltage at the input voltage indication node 762 and adjusts voltage to be delivered to the LDO regulator through the input voltage indication node 762 and a resistor R. The voltage adjusting circuit may cause an indication voltage at the input voltage indication node 762 to be adjusted to force the primary voltage regulator 704 to adjust the output voltage to be delivered (e.g., input voltage of the transistor 740) to the LDO regulator.

For example, when there is a small difference between the target input voltage and the current input voltage, the second amplifier amplifies this difference. The amplified difference is provided to a gate of the transistor 754 causing the transistor 754 to be turned on when the amplified difference is sufficient and causing current to sink through the transistor 754 to ground 764. The sinking current causes the voltage across resistor R to increase. Because the voltage of node 762 is regulated to be constant by the primary voltage regulator 704 (e.g., buck controller), the output of the primary voltage regulator (e.g., Buck_Vout), which is also the input of the LDO regulator (LDO_Vin), increases and settles at the target value (e.g., the output voltage of LDO plus the offset of the unity-gain amplifier (vdsat of the LDO powerFET)).

In one aspect of the present disclosure, the current sink through the transistor 754 may be adjusted by adjusting a resistance (e.g., at resistor R) connected to node 762. For example, the resistance of the resistor (e.g., variable resistor) may be increased to reduce the sink current through the transistor 754. The resistor, R, may be external to the primary voltage regulator 704. Alternatively, the resistor, R, may be internal to the primary voltage regulator 704.

Accordingly, the analog implementation causes the input voltage of the transistor 740 to be automatically adjusted to a target input voltage such that the transistor 740 of the LDO regulator operates in a saturation region. For example, the primary voltage regulator 704 is forced to cause the input voltage of the LDO regulator to substantially equal the target input voltage.

Figure 8:
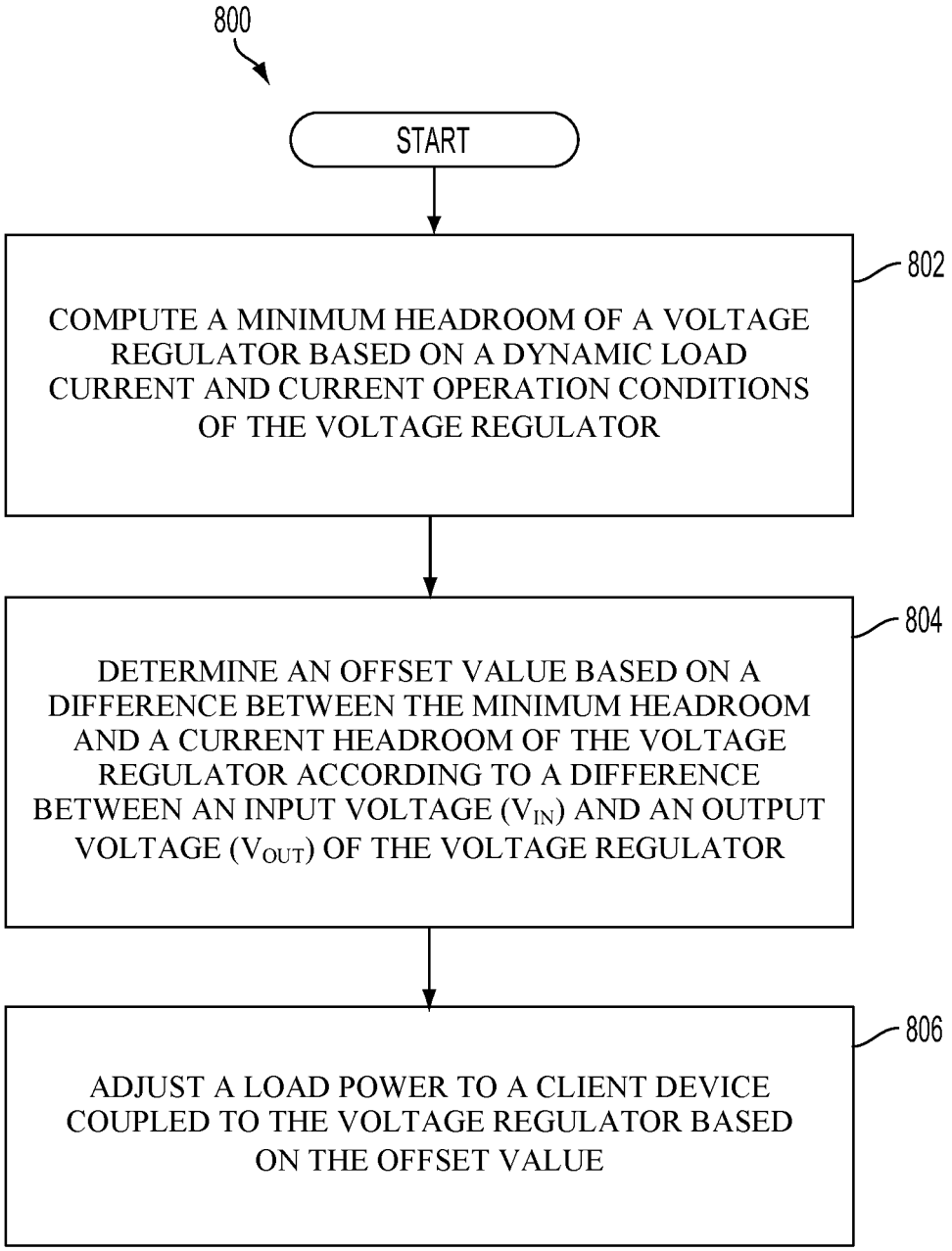
FIG. 8 depicts a simplified flowchart of a method for controlling headroom of a low dropout (LDO) regulator according to one aspect of the present disclosure.

FIG. 8 depicts a flowchart of a method for controlling headroom of a low dropout (LDO) regulator according to one aspect of the present disclosure. At block 802, minimum headroom of the voltage regulator (e.g., transistor of the voltage regulator) is computed based on a dynamic load current and current operation conditions of the voltage regulator. At block 804, an offset value is determined based on a difference between the minimum headroom and a current headroom of the voltage regulator according to a difference between an input voltage ($V_{IN}$) and an output voltage ($V_{OUT}$) of the voltage regulator. At block 806, a load power to a client device coupled to the voltage regulator is adjusted based on the offset value.

According to a further aspect of the present disclosure, headroom control for an LDO regulator is described. The LDO regulator includes means for supplying a load power including an output voltage supply rail according to an input supply rail from an upstream voltage regulator. The supplying means may be the regulator 104, the LDOs 202, the LDO module 302, the LDO regulator 502, the transistor 340, the transistor 540, and/or the transistor 740. The LDO regulator includes means for dynamically detecting a target operating condition for the load power supplying means and a target headroom of the load power supplying means. The detecting means may be the transistors (M3, M4, M5, M6, M7, M8, M9, and M10), the pair of unbalanced input transistors (M1 and M2), and/or the current source 436, shown in FIG. 4. The LDO regulator also includes adjusting the load power to a client device based on the offset value, the load power adjusting means coupled to the load power supplying means. The load power adjusting means may be the Vout control logic 112, sensor logic 110, power management integrated circuit (PMIC) 320, primary voltage regulator 310, LDO module 302, tracking circuit 400, digital controller 570, LDO regulator 502, analog implementation circuit 600 and/or primary voltage regulator 504/704. In another aspect, the aforementioned means may be any layer, module, or any apparatus configured to perform the functions recited by the aforementioned means.

Figure 9:
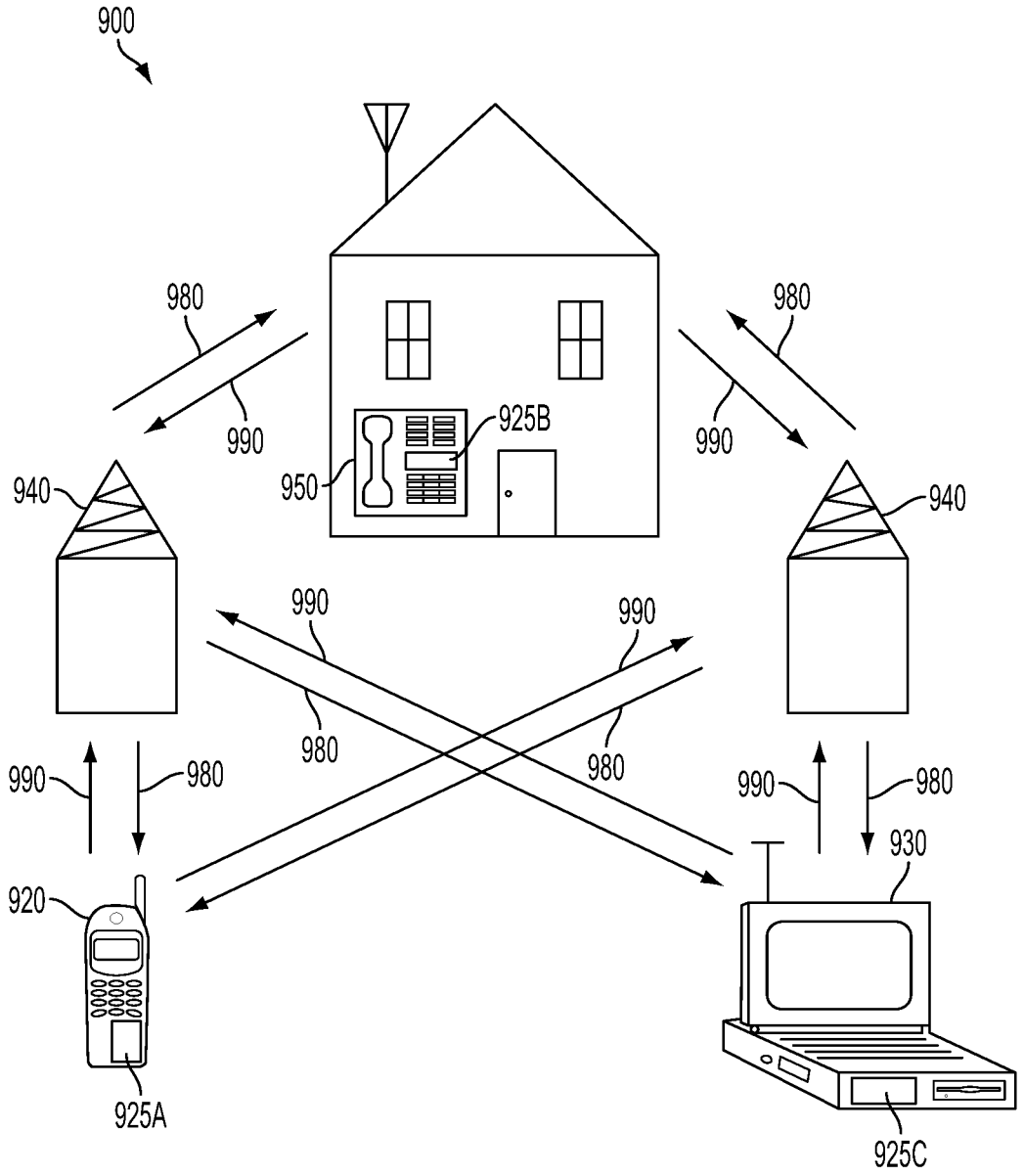
FIG. 9 is a block diagram showing an exemplary wireless communication system in which an aspect of the present disclosure may be advantageously employed.

FIG. 9 is a block diagram showing an exemplary wireless communication system 900 in which an aspect of the present disclosure may be advantageously employed. For purposes of illustration, FIG. 9 shows three remote units 920, 930, and 950 and two base stations 940. It will be recognized that wireless communication systems may have many more remote units and base stations. Remote units 920, 930, and 950 include IC devices 925A, 925C, and 925B that include the disclosed headroom control of an LDO regulator. It will be recognized that other devices may also include the disclosed headroom control, such as the base stations, switching devices, and network equipment. FIG. 9 shows forward link signals 980 from the base station 940 to the remote units 920, 930, and 950 and reverse link signals 990 from the remote units 920, 930, and 950 to base station 940.

In FIG. 9, remote unit 920 is shown as a mobile telephone, remote unit 930 is shown as a portable computer, and remote unit 950 is shown as a fixed location remote unit in a wireless local loop system. For example, a remote units may be a mobile phone, a hand-held personal communication systems (PCS) unit, a portable data unit such as a personal digital assistant (PDA), a GPS enabled device, a navigation device, a set top box, a music player, a video player, an entertainment unit, a fixed location data unit such as a meter reading equipment, or other communications device that stores or retrieve data or computer instructions, or combinations thereof. Although FIG. 9 illustrates remote units according to the aspects of the present disclosure, the disclosure is not limited to these exemplary illustrated units. Aspects of the present disclosure may be suitably employed in many devices, which include the disclosed r headroom control.

For a firmware and/or software implementation, the methodologies may be implemented with modules (e.g., procedures, functions, and so on) that perform the functions described herein. A machine-readable medium tangibly embodying instructions may be used in implementing the methodologies described herein. For example, software codes may be stored in a memory and executed by a processor unit. Memory may be implemented within the processor unit or external to the processor unit. As used herein, the term "memory" refers to types of long term, short term, volatile, nonvolatile, or other memory and is not to be limited to a particular type of memory or number of memories, or type of media upon which memory is stored.

If implemented in firmware and/or software, the functions may be stored as one or more instructions or code on a computer-readable medium. Examples include computer-readable media encoded with a data structure and computer-readable media encoded with a computer program. Computer-readable media includes physical computer storage media. A storage medium may be an available medium that can be accessed by a computer. By way of example, and not limitation, such computer-readable media can include RAM, ROM, EEPROM, CD-ROM or other optical disk storage, magnetic disk storage or other magnetic storage devices, or other medium that can be used to store desired program code in the form of instructions or data structures and that can be accessed by a computer; disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

In addition to storage on computer-readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and its advantages have been described in detail, it should be understood that various changes, substitutions and alterations can be made herein without departing from the technology of the disclosure as defined by the appended claims. For example, relational terms, such as "above" and "below" are used with respect to a substrate or electronic device. Of course, if the substrate or electronic device is inverted, above becomes below, and vice versa. Additionally, if oriented sideways, above and below may refer to sides of a substrate or electronic device. Moreover, the scope of the present application is not intended to be limited to the particular configurations of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

Those of skill would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, multiple microprocessors, one or more microprocessors in conjunction with a DSP core, or any other such configuration.

The steps of a method or algorithm described in connection with the disclosure may be embodied directly in hardware, in a software module executed by a processor, or in a combination of the two. A software module may reside in RAM, flash memory, ROM, EPROM, EEPROM, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general-purpose or special-purpose computer. By way of example, and not limitation, such computer-readable media can include RAM, ROM, EEPROM, CD-ROM or other optical disk storage, magnetic disk storage or other magnetic storage devices, or any other medium that can be used to carry or store specified program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD) and Blu-ray disc where disks usually reproduce data magnetically, while discs reproduce data optically with lasers. Combinations of the above should also be included within the scope of computer-readable media.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "a step for."

What is claimed is:

1. A method for headroom control in a voltage regulator, comprising:

computing a minimum headroom of the voltage regulator based at least in part on a dynamic load current and current operation conditions of the voltage regulator;

determining an offset value based at least in part on a difference between the minimum headroom and a current headroom of the voltage regulator according to a difference between an input voltage ($V_{IN}$) and an output voltage ($V_{OUT}$) of the voltage regulator; and adjusting a load power to be provided to a client device coupled to the voltage regulator based at least in part on the offset value.

2. The method of claim 1 in which adjusting the load power further comprises receiving an adaptively adjusted input voltage at an input of the voltage regulator from an upstream voltage regulator based at least in part on the offset value.

3. The method of claim 2, in which the adaptively adjusted input voltage is greater than the input voltage ($V_{IN}$) when the dynamic load current increases.

4. The method of claim 2, in which the adaptively adjusted input voltage is lower than the input voltage ($V_{IN}$) when the dynamic load current decreases.

5. The method of claim 2, further comprising biasing the voltage regulator to operate according to the minimum headroom based at least in part on the adaptively adjusted input voltage.

6. The method of claim 1 in which adjusting the load power further comprises adjusting the dynamic load current to be provided to the client device coupled to the voltage regulator based at least in part on the offset value.

7. The method of claim 1, further comprising integrating the voltage regulator into at least one of a music player, a video player, an entertainment unit, a navigation device, a communications device, a personal digital assistant (PDA), a fixed location data unit, a mobile phone, and a portable computer.

8. A power management integrated circuit, comprising:

a downstream voltage regulator including a power transistor to supply a load power including an output voltage supply rail according to an input supply rail from an upstream voltage regulator;

a tracking circuit to dynamically detect a target operating condition for the power transistor and a target headroom of the downstream voltage regulator corresponding to the target operating condition of the power transistor, the dynamic detection based at least in part on a dynamic load current and current operation conditions of the downstream voltage regulator;

feedback circuitry to generate an offset value based at least in part on a difference between the target headroom and a current headroom of the downstream voltage regulator; and load power adjustment circuitry to adjust the load power to a client device coupled to the downstream voltage regulator based at least in part on the offset value.

9. The power management integrated circuit of claim 8, in which the feedback circuitry is configured to feedback the offset value to the upstream voltage regulator to cause the upstream voltage regulator to provide an adaptively adjusted input voltage at an input of the downstream voltage regulator.

10. The power management integrated circuit of claim 8, in which the load power adjustment circuitry adjusts the load power by adjusting the dynamic load current to be provided to the client device coupled to the downstream voltage regulator based at least in part on the offset value.

11. The power management integrated circuit of claim 8, in which the current operation conditions comprise temperature and process corners.

12. The power management integrated circuit of claim 8, in which the feedback circuitry further comprises a comparator configured to detect and compare the target headroom and the current headroom and to generate the offset value based at least in part on a difference between the target headroom and the current headroom of the downstream voltage regulator.

13. The power management integrated circuit of claim 8, in which the feedback circuitry further comprises voltage adjusting circuitry to receive the offset value and to cause the upstream voltage regulator to adjust an input voltage provided to the power transistor based at least in part on whether the offset value is above a threshold.

14. The power management integrated circuit of claim 8, in which the tracking circuit further comprises:

a pair of unbalanced input transistors to track operating conditions of the power transistor to detect the target operating condition for the power transistor and the target headroom of the downstream voltage regulator, the pair of unbalanced transistors, comprising:

a first transistor having a size and characteristics substantially similar to the size and characteristics of the power transistor, and a second transistor having a size that is a multiple of the size of the power transistor and characteristics that are substantially similar to the characteristics of the power transistor.

15. The power management integrated circuit of claim 14, in which the tracking circuit further comprises a current source to dynamically bias the pair of unbalanced transistors with an adjusted dynamic load current of the power transistor.

16. The power management integrated circuit of claim 14, in which the characteristics of the power transistor comprises mobility, gate oxide capacitance per unit area, channel width and channel length.

17. The power management integrated circuit of claim 8, integrated into at least one of a music player, a video player, an entertainment unit, a navigation device, a communications device, a personal digital assistant (PDA), a fixed location data unit, a mobile phone, and a portable computer.

18. A power management integrated circuit (PMIC), comprising:

means for supplying a load power including an output voltage supply rail according to an input supply rail from an upstream voltage regulator;

means for dynamically detecting a target operating condition for the load power supplying means and a target headroom of the load power supplying means corresponding to the target operating condition of the load power supplying means, the dynamic detection based at least in part on a dynamic load current and current operation conditions of the load power supplying means;

feedback circuitry configured to generate an offset value based at least in part on a difference between the target headroom and a current headroom of the load power supplying means; and means for adjusting the load power to a client device based at least in part on the offset value, the load power adjusting means coupled to the load power supplying means.

19. The power management integrated circuit of claim 18, in which the load power supplying means further comprises means for adjusting the dynamic load current to the client device coupled to the load power supplying means based at least in part on the offset value.

20. The power management integrated circuit of claim 18, in which the current operation conditions comprise temperature and process corners.

* * * * *